United States Patent [19]

Jones et al.

[11] 4,227,621

[45] Oct. 14, 1980

[54] SEALED TUB

[76] Inventors: Leslie Jones, R.R. #2, Cumberland, Canada, K0A 1S0; Roger Paradis, 1172 Grenoble Cres., Orleans, Canada, K1C 2C6

[21] Appl. No.: 40,852

[22] Filed: May 21, 1979

Related U.S. Application Data

[63] Continuation-in-part of Ser. No. 876,487, Feb. 9, 1978, abandoned.

[30] Foreign Application Priority Data

Jan. 31, 1978 [CA] Canada ..... 295988

[51] Int. Cl.[3] ..... B65D 8/04; B65D 8/16; B65D 25/14

[52] U.S. Cl. ..... 217/96; 4/506; 4/538; 217/3 CB; 217/88; 220/457; 428/529

[58] Field of Search ..... 428/529; 4/172, 172.19, 4/173, 174, 175; 217/4, 88, 96, 3 CB, 72, 3 R; 220/457

[56] References Cited

U.S. PATENT DOCUMENTS

| | | | |
|---|---|---|---|
| 1,032,675 | 7/1912 | Holland | 217/96 |
| 1,306,616 | 6/1919 | Parton | 217/72 |
| 2,027,403 | 1/1936 | Shepherd | 217/72 |
| 2,354,342 | 7/1944 | Walker | 217/96 |
| 3,323,265 | 6/1967 | Petersen | 217/91 X |
| 3,329,174 | 7/1967 | Pfeil | 217/96 X |
| 3,949,149 | 4/1976 | Cherubim et al. | 428/529 |

FOREIGN PATENT DOCUMENTS

| | | | |
|---|---|---|---|
| 159328 | 3/1940 | Fed. Rep. of Germany | 217/72 |
| 590441 | 6/1925 | France | 217/96 |
| 6958 | of 1902 | United Kingdom | 217/96 |
| 25853 | of 1912 | United Kingdom | 217/3 CB |

*Primary Examiner*—Allan N. Shoap
*Attorney, Agent, or Firm*—Dennison, Dennison, Meserole & Pollack

[57] ABSTRACT

A stave for a tub has opposite elongate edges formed with formations each having a section transverse to the stave including an arcuate portion, and a rabbet for receiving a floor of the tub extending between the edges. The formations on each stave are desirably complementary, but need not be. Staves placed in edge-to-edge relation define a tub wall which can conform to an arbitrary shape and size. A tub is formed by a plurality of staves, an appropriately shaped floor, and bands extending around the outside of the tub wall.

3 Claims, 8 Drawing Figures

SEALED TUB

This application is a continuation-in-part of application Ser. No. 876,487, filed Feb. 9, 1978, now abandoned.

This invention relates to a tub, such as a so-called hot tub or whirlpool spa, and to a method of and parts for making it.

Coopers have, for a very long time, made tubs and barrels by cutting each edge of curved or straight staves, which make up the side of the tub or barrel, to a precise predetermined angle, placing a predetermined number of staves in edge-to-edge relation to form a cylindrical body, attaching thereto one or two circular wooden ends, and banding the body with iron bands. This method suffers from the disadvantage that the angle cut on each stave edge is dependent upon the diameter of the tub and the width of the stave. Accordingly tubs of particular diameters and/or stave widths must be designed and manufactured on an individual basis. This can be seen from the fact that, for example, a 3 foot diameter tub would require 4 inch wide staves cut to a stave angle of 6.4 degrees but would require 6 inch wide staves to be cut to a stave angle of 9.5 degrees, and a 4 foot diameter tub would require 6 inch wide staves cut to a stave angle of 7.2 degrees.

A further disadvantage of this known method is that it is not readily possibly to form tubs of non-circular cross-section. For example, to provide a tub of elliptical cross-section, it would be necessary to draw the elliptical cross-section, determine thereon the position of each stave, and to draw normals to the ellipse each cutting the ellipse at the junction between two staves to determine the stave angles for the individual staves. Each stave would then in general have different stave angles to the adjacent stave and different stave angles on its opposite edges. This same degree of complexity of design, and consequently also manufacture and stocking, of the staves applies to other curves, for example heart, kidney, and pear shapes.

An object of the present invention is to provide an improved stave which can be used in different and arbitrarily shaped and sized tubs, and an improved tub including such staves.

The invention also seeks to provide improved apparatus, including such staves, for forming a tub and a method of forming a tub using such apparatus.

According to one aspect of the invention there is provided a stave comprising an elongate member having opposite elongate edges formed along their lengths with formations each of which, in a section transverse to the length of the member, includes a substantially arcuate portion which is engageable with a complementary portion of another stave when said staves are placed in edge-to-edge relation, said member further having a rabbet in an elongate face thereof extending between said elongate edges transversely of the length of the member and between the ends thereof.

According to another aspect of the invention there is provided, for forming a tub, a plurality of staves each as recited above, said staves being able to be placed in edge-to-edge relation with the formations on the elongate edges of adjacent staves engaging one another to form a continuous wall of a tub with a continuous groove on the inner side of said wall formed by the rabbets in the staves; at least one member engageable within said groove to form a floor of the tub; and at least one band engageable around said staves on the outer side of said wall for retaining said staves in place.

The invention extends to a method of forming a tub from the apparatus recited above, comprising the steps of disposing said staves in said edge-to-edge relation with said groove engaging said at least one member to form said continuous wall and floor of the tub, and engaging said at least one band around said staves on the outer side of said wall to retain said staves in place.

According to a further aspect of the invention there is provided a tub comprising a continuous wall formed by a plurality of staves disposed in edge-to-edge relation, each stave comprising an elongate member having opposite elongate edges formed along their lengths with formations each of which, in a section transverse to the length of the member, includes a substantially arcuate portion which engages a corresponding portion of the adjacent stave, the member forming each stave further having a rabbet in that elongate face thereof which forms part of the inner side of said wall, said rabbet extending between said elongate edges of the member transversely of the length and between the ends thereof, the rabbets in said staves being aligned to form a continuous groove in said wall; a floor of the tub formed by at least one member engaged within said groove; and at least one band engaged around said staves on the outer side of said wall retaining said staves in place.

The substantially arcuate form of the elongate edges of the staves enables the staves to be disposed in edge-to-edge relation at arbitrary angles to one another and thus avoids the need for the staves to be cut to precise predetermined stave angles. Thus the staves can be arranged to conform substantially to any desired curved or straight path, without the need for individual staves to be provided for individual positions along such path.

In preferred embodiments of the invention, the substantially arcuate portions of the formations on the opposite elongate edges of the member are complementary to one another. This facilitates the disposition of the staves in edge-to-edge relation in that it enables a convex formation on one edge of each stave to be received in a complementary concave formation on the relevant edge of the adjacent stave. In contrast, known staves cut to precise stave angles are more difficult to position and retain in precise edge-to-edge relation during construction of the tub.

The above advantage can also be provided in accordance with the invention by providing staves of two types, one of which has convex formations on both elongate edges and the other of which has concave formations, complementary to the convex formations, on both edges, the two types of staves being disposed alternately around the circumference of the tub. However, this involves the provision of the two types of staves, as opposed to merely one type being required according to the preferred embodiment recited above.

Staves of only said one type, having convex formations on both elongate edges, can be used to form a tub within the broadest aspects of this invention, but the advantage that the disposition of the staves in edge-to-edge relation is facilitated is then lost. This advantage is particularly important when a tub is to be constructed by an individual not skilled in the art of tub-making.

It is also conceivable, without departing from the present invention, to mix the three above-described types of staves otherwise in a single tub.

It is also preferred that the diameter of a circle which is defined by the substantially arcuate portions of the formations is not greater than the thickness of the member between the opposite elongate faces thereof. This facilitates the provision of a relatively smooth surface provided by the staves, especially on the inner sides of curved paths followed by the staves.

The staves are preferably of wood, which in use of the tub absorbs water and swells to provide a substantially water-tight seal between the staves without any separate sealant being required. For similar reasons, the floor of the tub is also preferably of wood.

The bands around the tub are preferably metal straps, for example of stainless steel or some other material which has sufficient tensile strength and is corrosion-resistant or is protected against corrosion. The straps can be retained around the staves by any suitable means; for example each strap may have at one end a captive bolt and at the other end a nut secured thereto, in which case the bolt may be screwed into the nut to retain and tighten the strap around the staves. Naturally, it will be appreciated that it may be necessary to provide spacers between the bands and the staves in any region of the tub in which, as a result of the shape of the tub, the tightened bands do not provide a sufficient retaining force on the staves. This may particularly be the case in any generally concave region of the tub wall.

The invention will be further understood from the following detailed description by way of example of embodiments thereof with reference to the accompanying drawings, in which.

Figure 1:
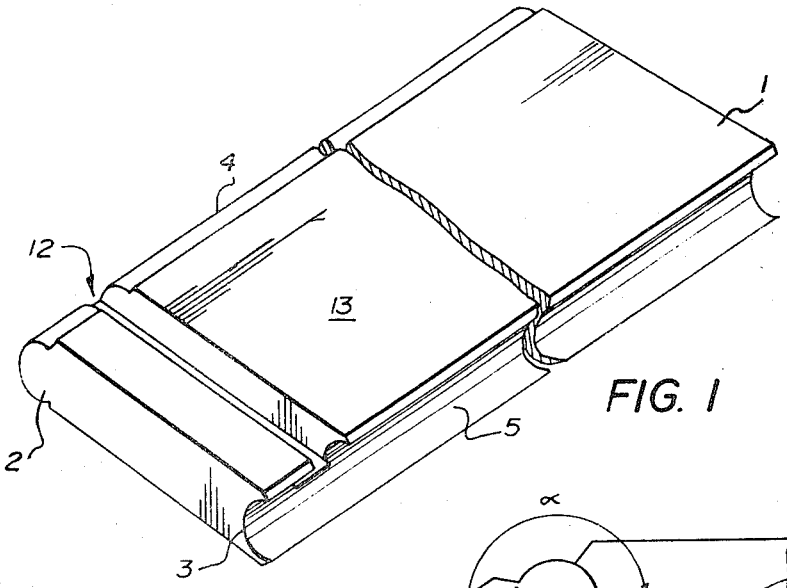
FIG. 1 illustrates in a perspective view a preferred embodiment of a stave according to the present invention.

FIG. 1 illustrates a stave 1 in the form of a wooden member whose length corresponds to the overall height of a tub to be made from a plurality of such staves and is, for example, four feet. The stave has a cross-sectional size which is arbitrary, but for example conveniently about $5\frac{1}{2}$ inches by $1\frac{5}{8}$ inches so that the stave is readily formed from 6 inch by 2 inch wood. These figures are given purely by way of example and it is clear that any practical width, thickness, and length of stave may be used in any particular circumstnces.

Figure 2:
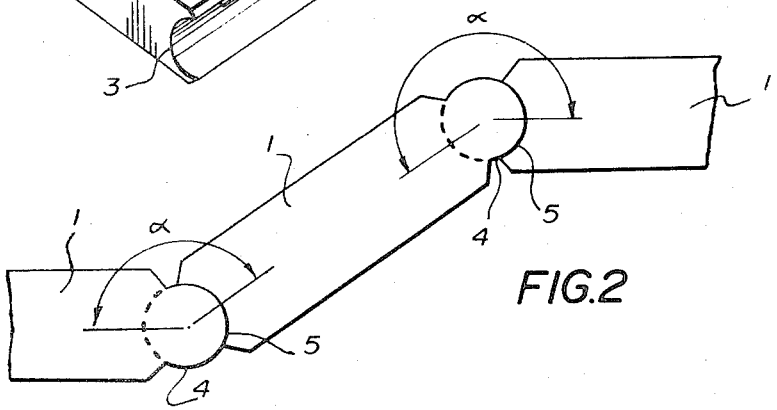
FIG. 2 illustrates an end view of the stave of FIG. 1, also showing parts of similar staves disposed in edge-to-edge relation therewith.

The opposite elongate edges 2 and 3 of the stave 1 are formed along their lengths with formations each of which, in a section transverse to the length of the stave and hence as shown by the end view in FIG. 2, includes a substantially arcuate portion which is engageable with a complementary portion of another stave when said staves are placed in edge-to-edge relation. Thus the edge 2 is formed with a convex portion 4 which extends the entire length of the stave 1, and the edge 3 is formed with a complementary, concave, portion 5 which also extends the entire length of the stave 1. A plurality of such staves may be placed in edge-to-edge relation as shown in FIG. 2, with the convex portion 4 of one stave received in the concave portion 5 of the adjacent stave, to form a wall of a tub. The wall can substantially follow any desired curved or straight path by appropriate choice of the stave dimensions and the angles which adjacent staves make with respect to one another. FIG. 2 shows for example that the staves may be disposed to form an angle $\alpha$ therebetween which can be less than or greater than 180°.

FIG. 2 shows that the diameter of the circle defined by the substantially arcuate portion of the cross-sectional shape of the stave is, in this example, less than the thickness between the opposite faces of the stave. For example this diameter can be $1\frac{1}{4}$ inches when the stave thickness is $1\frac{5}{8}$ inches. This enables the angle $\alpha$ between adjacent staves to vary within a large range, for example in the case illustrated in FIG. 2 from about 90° to about 270°.

Figure 3:
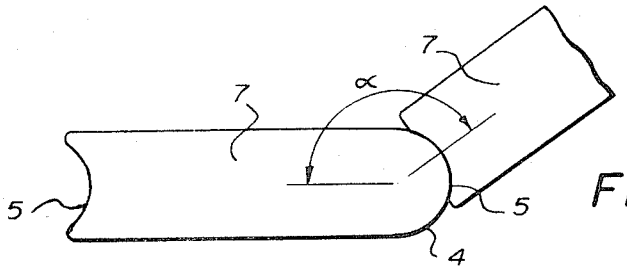
FIGS. 3 to 6 illustrate end views of alternative forms of staves according to the present invention, also illustrating the edge-to-edge relationship thereof.

FIG. 3 illustrates an end view of an alternative form of stave 7 which is identical to the stave 1 except that the diameter of the circle defined by the arcuate portions formed at the elongate edges of the stave is equal to the thickness of the stave. The stave 7 again has complementary convex and concave formations 4 and 5 respectively. However, the increased diameter of these formations reduces the range within which the angle $\alpha$ between adjacent staves placed in edge-to-edge relation may be varied.

Figure 4:
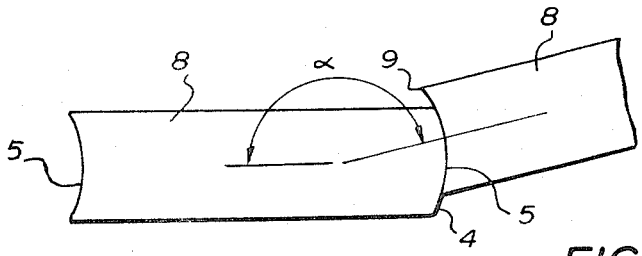

FIG. 4 illustrates similar staves 8 having complementary convex and concave edge formations 4 and 5 respectively the diameter of which is greater than the thickness of the staves 8. The further increased diameter has the disadvantage of further reducing the range within which the angle $\alpha$ between adjacent staves placed in edge-to-edge relation may be varied. In addition, in this case when the angle $\alpha$ is not 180° the adjacent staves become offset relative to one another, the degree of offset being dependent upon the amount by which the angle $\alpha$ differs from 180°. This offset results in undesirable projections 9 being formed on the internal angle side of the wall formed by the adjacent staves.

Figure 5:
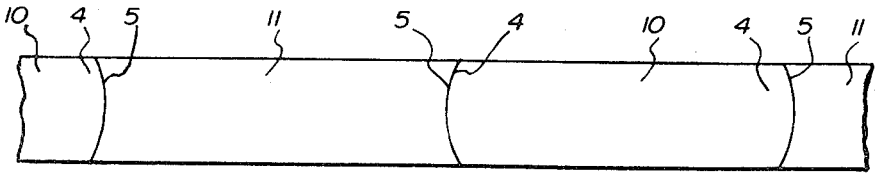

The formations on the elongate edges of the individual staves of FIGS. 1 to 4 are complementary to one another, but this need not necessarily be the case. For example, FIG. 5 shows staves 10 and 11 disposed in edge-to-edge relation and alternating with one another to form a wall which is shown as being straight but which could equally well be curved. The staves 10 have convex formations 4 on both elongate edges, and the staves 11 have concave formations, which are complementary to the convex formations 4, on both elongate edges. It will be appreciated that the same comments as are made above in relation to the staves of FIGS. 1 to 4 apply to the staves 10 and 11, except that now two types of stave are required to be used alternately to form the wall.

Figure 6:
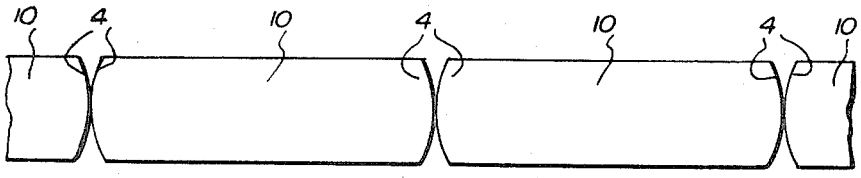

FIG. 6 shows that a wall may be formed by the staves 10 alone, placed in edge-to-edge relation so that the convex formations 4 on the elongate edges thereof abut one another. In this case only the one type of stave 10 is required to form a wall, but the disposition and retention of the adjacent staves 10 in edge-to-edge relation is made considerably more difficult in that now convex formation abut one-another, rather than convex formations being received in complementary concave formations as is the case for the staves of FIGS. 1 to 5.

From the above description it will be seen that the staves of FIGS. 1 to 6 may be combined, in the same or different widths and the same or different types, to form a continuous wall of arbitrary shape and size. For the reasons already explained above, namely the large range within which the angle $\alpha$ can be varied, the ease of disposing and retaining staves in edge-to-edge relation by engaging convex formations with complementary concave formations on the stave edges, and the need for only a single type of stave, the form of the stave 1 of FIGS. 1 and 2 is preferred. Accordingly the remaining description relates only to this type of stave, but it should be appreciated that exactly the same applies to the other staves shown in FIGS. 3 to 6 as described above.

Referring again to FIG. 1, each stave 1 is also provided between its ends, preferably spaced by only a short distance such as 1½ from one end, with a rabbet 12 in one elongate face 13 of the stave. The rabbet 12 extends transversely of the stave from one elongate edge 2 and the associated formation 4 to the other edge 3 and its associated formation 5. The rabbet 12 has a depth which is for example half the thickness of the stave, and a width which corresponds to the thickness of a base which is in use of the stave received therein. The rabbet width is for example ¾ inch. FIG. 1 shows the rabbet 12 as having a constant rectangular section, but it may alternatively have a nonrectangular and/or varying section. When a plurality of the staves are appropriately disposed in edge-to-edge relation to form a continuous wall, the rabbets 12 therein are aligned with one another to form a continuous groove on the inside of this wall, in which the edges of an appropriately shaped base are received to form the walls and a base of a tub.

Figure 7:
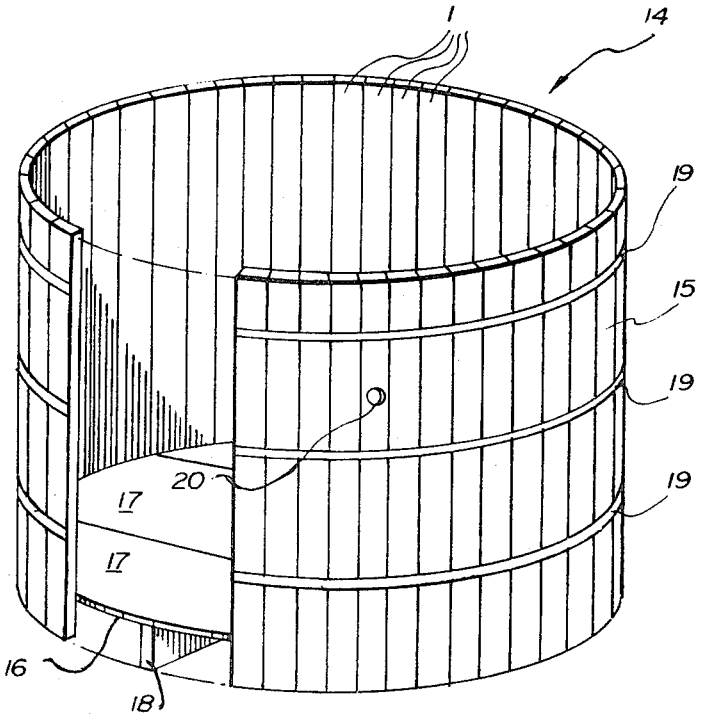
FIG. 7 illustrates a partly cut-away view of a tub according to an embodiment of the present invention, the details of the staves thereof not being shown for the sake of simplicity and clarity.

FIG. 7 illustrates by way of example a circular tub 14 formed by a plurality of staves 1 disposed in edge-to-edge relation to form a circular wall 15. For simplicity and clarity the details of the elongate edges of the staves are not shown. The circular shape of the tub 14 is defined by a circular base 16 which comprises, in this example, a plurality of pieces 17 of medium density overlaid plywood in edge-to-edge relation which are for example joined together by dowels not shown. The base 16 is further supported and strengthened by one or more sub-floor cross members 18 to which the pieces 17 are joined or on which they rest. The edge of the circular base 16 is received within the continuous groove formed by the aligned rabbets 12 in the staves 1, the tub floor and wall being made up by disposing the individual staves 1 successively adjacent one another in edge-to-edge relation and at the same time engaging the edge of the base 16 in the rabbet 12 in the respective stave. The positive engagement of convex and concave formations on the edges of the staves considerbly assists in the disposition and retention of the staves in place, as well as enabling the wall 15 to conform to the circular path.

On completion of the wall 15, one or more bands 19, three of which are shown in FIG. 7, are disposed around the outside of the wall to retain the staves 1 in place. Each band 19 is for example in the form of a strap of stainless steel or other suitable corrosion-resistant or protected material the ends of which are secured together, and the band tightened, by suitable means of known form (not shown). For example one end of each strap may engage a captive bolt and the other end may engage a correspondingly threaded nut, the bolt being screwed into the nut to secure the strap around the wall 14 and tighten the band 19 formed thereby. The number of bands 19 which is provided will depend on the size of the tube 14 and the nature and size of the bands. For example a tub 6 feet in diameter might have four bands 19 each of 1½ inch wide 16 gauge stainless steel.

One or more of the staves 1 is or are also provided with a hole 20 for the supply of heated water to the tub 14. One or more staves is or are also provided with an outlet, and/or the base 16 is provided with one or more drain holes, (not shown) for the removal of water from the tub. In use of the tub 14, the tub is filled and water is circulated therethrough via the hole(s) 20, which may be provided with appropriate valves, jets, and air-induction devices of known form, and the outlet(s) and/or drain hole(s). The circulation system can be of known form and conveniently includes a filter, chlorinator, heater, and pump.

As has been explained above, the base or floor 16 of the tub 14 and the staves 1 are preferably of wood. Accordingly, when the tub 14 is filled with water, the wood swells by absorbing water. The abutting surfaces of adjacent staves therefore define a sealing zone to form a water-tight seal between the staves.

Figure 8:
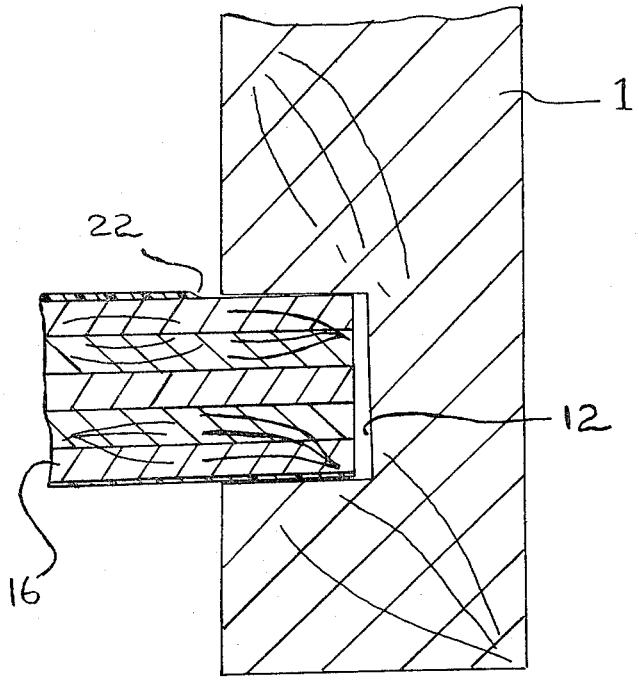
FIG. 8 shows an detailed view of a portion of a stave and base.

As can best be seen in FIG. 8 the base 16 is engaged with the flanks of the rabbets 12. By utilizing a laminated material such as plywood in which the grain in adjacent layers is at right angles it has been found that improved sealing is achieved. The swelling of the base occurs in a direction normal to the plane of the base (i.e. the thickness increases) rather than in the plane of the base. Thus the base seals against the flanks of the rabbet over a large area and is not effected by small variations in the disposition of the staves. It will also be appreciated that the sealing forces act along the axis of the stave rather than normal thereto so that there is no tendency for adjacent staves to part due to swelling of the base.

It is preferred to use a phenolic coated plywood for the base in which case it has been found that the sealing function may be improved by removing the upper laminate and coating at the periphery of the base to provide a shoulder 22. This encourages penetration of water and subsequent swelling.

Materials other than wood may be used for the staves and/or the tub floor, but if such materials are not formed to provide a water-tight seal therebetween or do not swell by absorption of water it will be necessary to provide some separate means of ensuring an effective water-tight seal of the tub.

The invention is not limited to the particular embodiments thereof described above, and many modifications, variations and equivalent arrangements thereof which may occur to those skilled in the art are within the scope of the invention as defined by the following claims.

What we claim is:

1. A tub comprising:

a plurality of staves disposed in edge-to-edge relation and forming a continuous wall having an inner face and an outer face;

each of said staves comprising an elongate member generally in the form of a rectangular parallelepiped having opposite elongate faces, opposite elongate edges, and opposite ends;

each of said opposite elongate edges defining along its length a formation including a substantially part-cylindrical portion;

said part-cylindrical portion having an axis which is parallel to planes defined by said opposite faces engaging a corresponding portion of the adjacent stave to define at the area of engagement a sealing zone;

means defining a rabbet in one of said elongate faces of each of said elongate members;

the rabbets extending between said elongate edges of said elongate members transversely of the lengths and between said sealing zones thereof and having side walls generally normal to the axes of said elongate members;

said rabbets being aligned to form a continuous groove in the inner side of said wall;

a floor of said tub formed by at least one floor member engaged within said groove;

said floor member comprising a laminated plywood so oriented that immersion in water causes said plywood to swell more in a direction normal to the plane of said floor member than parallel thereto, whereby sealing of said floor member to said rabbet side walls without displacement of said elongate members outwardly of said tube is promoted;

elongate means extending around said elongate members on the outer side of said wall for retaining said staves in place, and said floor member having a water resistant protective coating which terminates inwardly of said inner face of said continuous wall to expose the uncoated plywood and thereby to promote localized swelling of said floor member in said direction.

2. A tub according to claim 1 wherein said protective coating is a phenolic resin.

3. A tub as claimed in claim 1 wherein the radius of each substantially part-cylindrical portion of each stave is not greater than half the thickness of the stave between said opposite elongate faces.

* * * * *